United States Patent [19]

Suzuki et al.

[11] Patent Number: 5,036,470

[45] Date of Patent: Jul. 30, 1991

[54] METHOD AND APPARATUS FOR DETERMINING HIGH TEMPERATURE STATE OF AIR-FUEL RATIO SENSOR

[75] Inventors: Makoto Suzuki, Mishima; Hiroshi Tanaka, Susono, both of Japan

[73] Assignee: Toyota Jidosha Kabushiki Kaisha, Japan

[21] Appl. No.: 368,245

[22] Filed: Jun. 19, 1989

[30] Foreign Application Priority Data

Jun. 20, 1988 [JP] Japan ..... 63-151685
Oct. 25, 1988 [JP] Japan ..... 63-269203

[51] Int. Cl.[5] ..... F02D 41/14; F02D 41/22; F02B 3/12

[52] U.S. Cl. ..... 364/431.06; 60/276; 123/440; 123/489

[58] Field of Search ..... 364/431.05, 431.06, 364/431.07; 123/440, 489, 491; 60/274, 275, 276

[56] References Cited

U.S. PATENT DOCUMENTS 4,167,925 9/1979 Hosaka et al. ..... 60/276
4,324,218 4/1982 Hattori et al. ..... 123/489
4,458,319 7/1984 Chuto et al. ..... 364/431.06
4,491,921 1/1985 Sugiyama et al. ..... 364/431.05
4,739,614 4/1988 Katsuno et al. ..... 60/274
4,872,117 10/1989 Suzuki et al. ..... 364/431.05
4,922,429 5/1990 Nakajima et al. ..... 364/431.05
4,933,863 6/1990 Okano et al. ..... 364/431.05

FOREIGN PATENT DOCUMENTS 57-105529 7/1982 Japan .
57-143143 9/1982 Japan .
61-129444 6/1986 Japan .
61-135950 6/1986 Japan .

*Primary Examiner*—Felix D. Gruber
*Attorney, Agent, or Firm*—Kenyon & Kenyon

[57] ABSTRACT

In an internal combustion engine having an air-fuel ration sensor, a lean-side extreme value of the output of the air-fuel ration sensor is calculated when the air-fuel ratio is lean, and a rich-side extreme value of the output of the air-fuel ratio sensor is calculated when the air-fuel ration is rich, and when both of these extreme values are on the rich side or when the mean value thereof is on the rich side, the air-fuel ratio sensor is determined to be in a high temperature state.

18 Claims, 18 Drawing Sheets

| Fig. 18A | Fig. 18B | Fig. 18C |
|---|---|---|

METHOD AND APPARATUS FOR DETERMINING HIGH TEMPERATURE STATE OF AIR-FUEL RATIO SENSOR

BACKGROUND OF THE INVENTION

1.) Field of the Invention

The present invention relates to a method and apparatus for determining a high temperature state of an air-fuel ratio sensor, such as a titania-type $O_2$ sensor, in an internal combustion engine.

2.) Description of the Related Art

Generally, in a feedback control of the air-fuel ratio sensor ($O_2$ sensor) system, a base fuel amount TAUP is calculated in accordance with the detected intake air amount and detected engine speed and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_x$ simultaneously from the exhaust gas.

As the above-mentioned $O_2$ sensor, a titania ($TiO_2$) type $O_2$ sensor having a high response characteristic is used. Namely, the element resistance of the titania $O_2$ sensor is small when the air-fuel ratio is rich, and is large when the air-fuel ratio is lean. The element resistance of the titania type $O_2$ sensor, however, is affected strongly by the temperature thereof, compared with zirconia type $O_2$ sensors; i.e., when the temperature of the titania type $O_2$ sensor is increased, an output thereof indicating a lean state is close to that indicating a rich state, and as a result, when the above-mentioned air-fuel ratio feedback control is carried out, the controlled air-fuel ratio may be overlean, thus increasing $NO_x$ emissions, and inviting knocking, misfiring, and the like. Therefore, it is important to detect a high temperature state of the titania type $O_2$ sensor. Note, such a high temperature state can be detected by incorporating a temperature sensor but this increases the manufacturing cost. In the prior art, such a high temperature state is detected by determining whether or not an extreme value, such as a minimum value, of the output of the titania type $O_2$ sensor is higher than a predetermined value (see Japanese Patent Publication Nos. 57-105529 and 57-143143).

In the above-mentioned prior art, however, even when the temperature of the titania type $O_2$ sensor is actually low, a high temperature state thereof is erroneously determined, as later explained in more detail.

SUMMARY OF THE INVENTION

An object of the present invention is to provide a method and apparatus for accurately detecting a high temperature state of an air-fuel ratio sensor, such as a titania type $O_2$ sensor, using the output thereof.

According to the present invention, in an internal combustion engine having an air-fuel ratio sensor, a lean-side extreme value of the output of the air-fuel ratio sensor is calculated when the air-fuel ratio is lean, and a rich-side extreme value of the output of the air-fuel ratio sensor is calculated when the air-fuel ratio is rich. When both of the extreme values are on the rich side or when the mean value thereof is on the rich side, the air-fuel ratio sensor is determined to be in a high temperature state.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
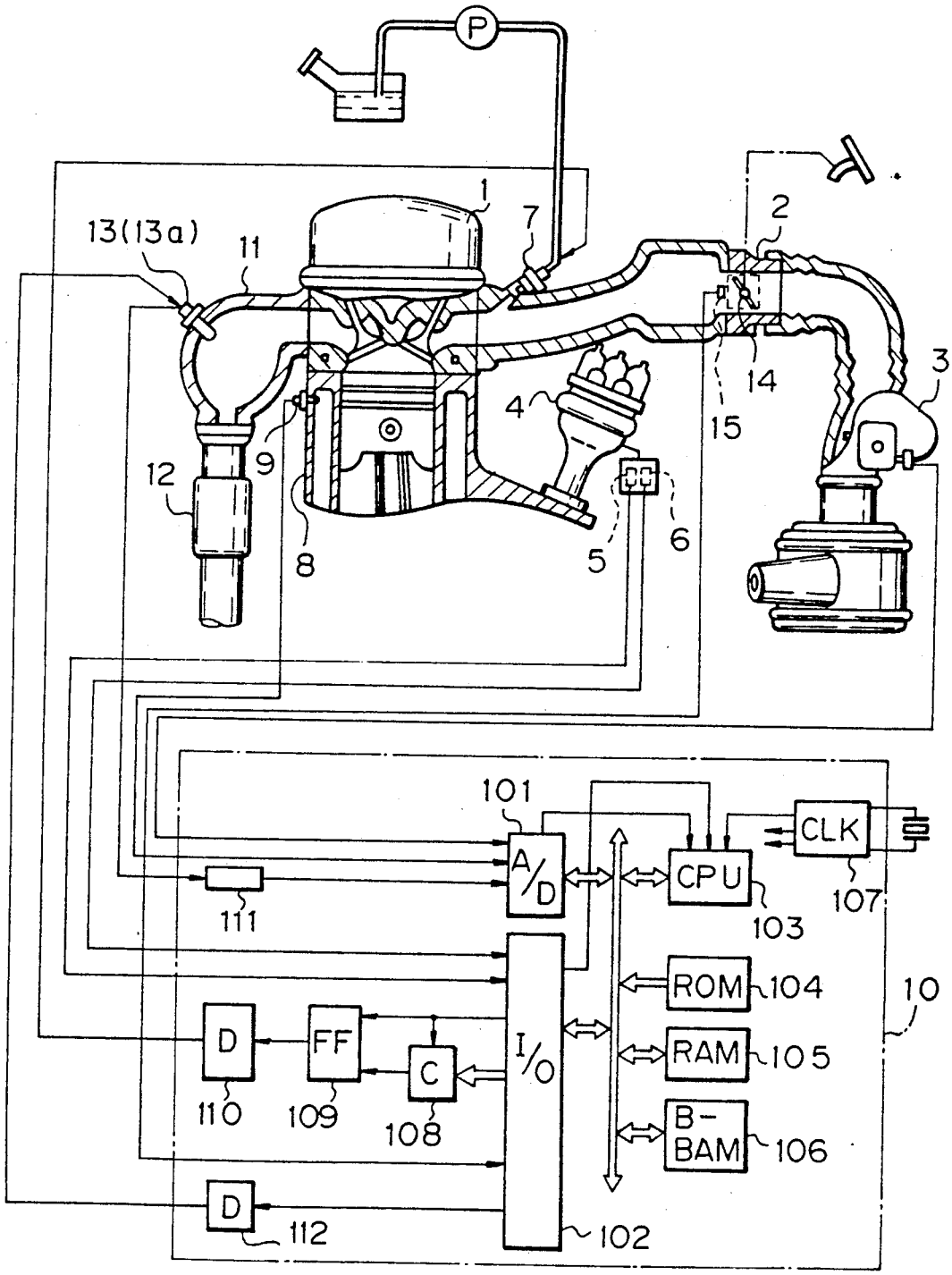
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 1.

Disposed in cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a titania type sensor 13 for detecting the concentration of oxygen composition in the exhaust gas. The $O_2$ sensor 13 generates an output voltage signal and transmits the signal via an input circuit 111 to the A/D converter 101 of the control circuit 10. Also, to operate the $O_2$ sensor 13 within a desired temperature range, a heater 13*a* is incorporated thereinto. The heater 13*a* is controlled by a drive circuit 112 of the control circuit 10.

Reference 14 designates a throttle valve, and 15 an idle switch for detecting whether or not the throttle valve 14 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a drive circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the drive circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the drive circuit 110 initiates the activation of the fuel injection valve 7. On the other hand, the down counter 108 counts up the clock signal from the clock generator 107, and finally generates a logic "1" signal from the borrow-out terminal of the down counter 108, to reset the flip-flop 109, so that the drive circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at predetermined intervals, and then stored in the RAM 105. That is, the data Q and THW in the RAM 105 are renewed at predetermined intervals. The engine speed Ne is calculated by an interrupt routine executed at 30° CA, i.e., at every pulse signal of the crank angle sensor 6, and is then stored in the RAM 105.

Figure 2:
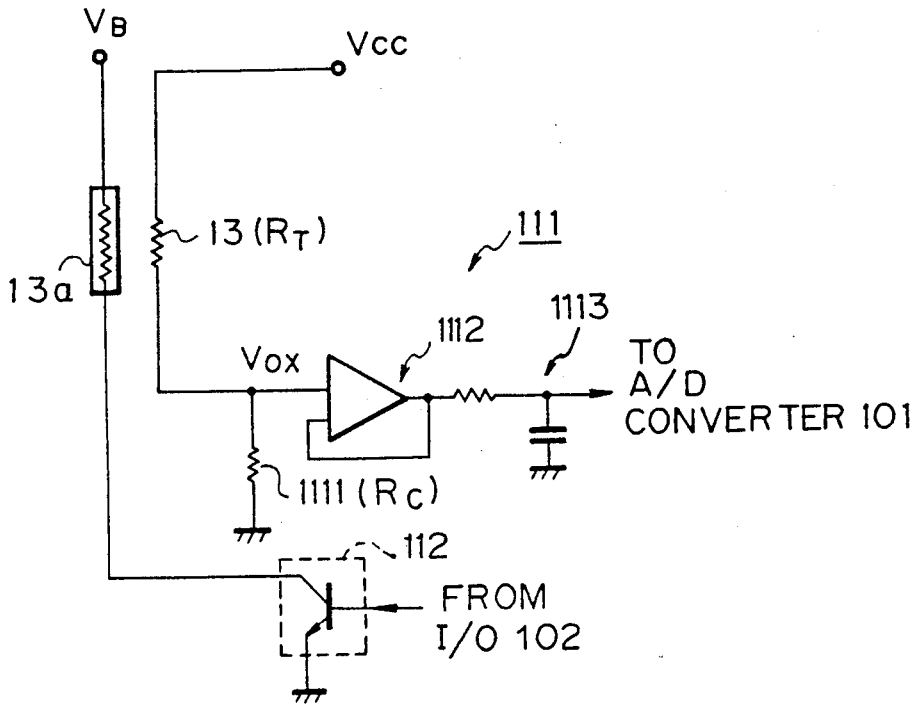
FIG. 2 is a circuit diagram of a part of the control circuit of FIG. 1.

As illustrated in FIG. 2, the input circuit IN for the output $V_{OX}$ of the $O_2$ sensor 13 is comprised of a reference resistor 1111 having a value of $R_C$ such as 50 kΩ, a voltage buffer 1112, and an integration circuit 1113.

Figure 3:
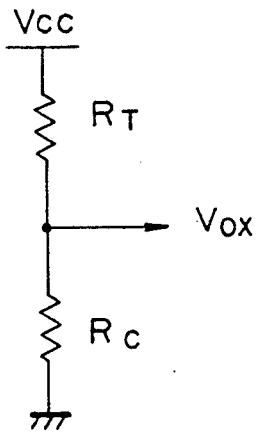
FIG. 3 is a circuit diagram of the $O_2$ sensor of FIG. 1.
Figure 4:
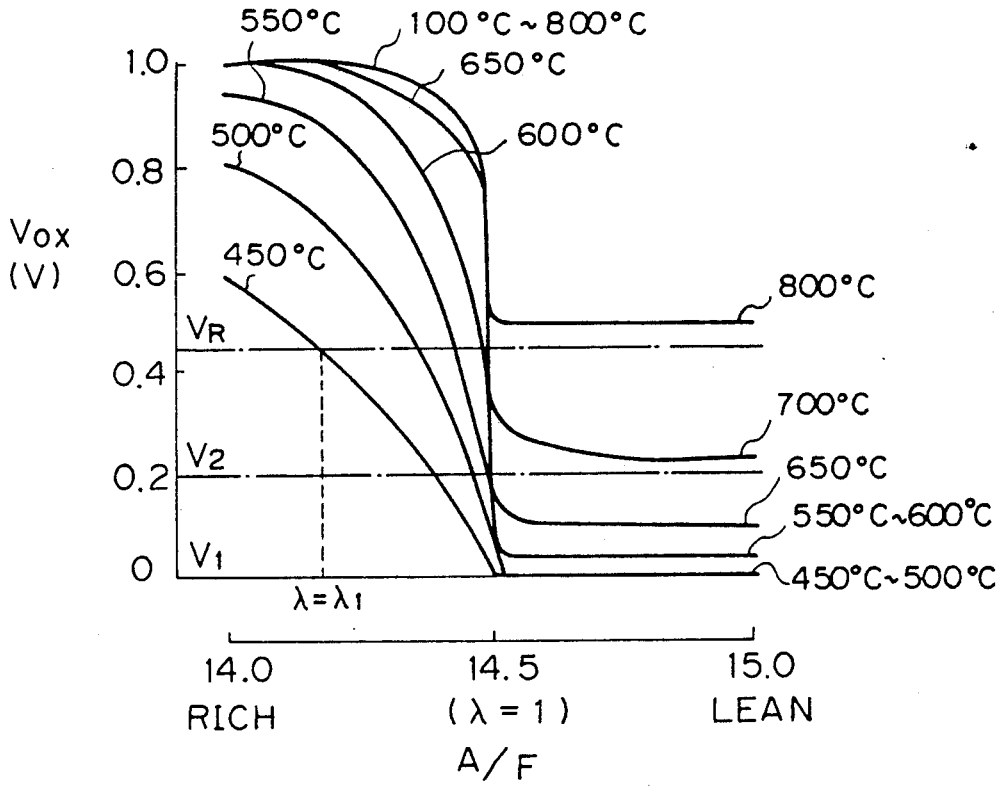
FIG. 4 is a graph showing output characteristics of the $O_2$ sensor of FIG. 1.

If the resistance value of the $O_2$ sensor 13 is denoted by $R_T$, and the resistance value of the reference resistor 1111 is denoted by $R_C$ as illustrated by FIG. 3, the output voltage $V_{OX}$ of the $O_2$ sensor 13 is represented by $$V_{OX} = V_{CC} \times \frac{R_C}{R_T + R_C}$$

where $V_{CC}$ is a power supply voltage such as 5 V. As illustrated in FIG. 4, when the air-fuel ratio is rich, the resistance value $R_T$ of the $O_2$ sensor 13 is lowered to increase the output $V_{OX}$ thereof. Conversely, when the air-fuel ratio is lean, the resistance value $R_T$ of the $O_2$ sensor 13 is increased to reduce the output $V_{OX}$ thereof. Also, the resistance value $R_T$ of the $O_2$ sensor 13, which in this case is a titania type, is affected strongly by the temperature thereof. Therefore, it is necessary to correct the output $V_{OX}$ of the $O_2$ sensor 13 by changing the temperature thereof, or to control the temperature per se.

Particularly, when the $O_2$ sensor 13 is at a high temperature such as 800° C., the output $V_{OX}$ is higher than a reference voltage $V_R$ such as 0.45 V even when the air-fuel ratio is actually lean, and as a result, the air-fuel ratio is erroneously determined to be rich, and accordingly, when the air-fuel ratio feedback control using the erroneously determined rich output $V_{OX}$ is carried out, the controlled air-fuel ratio is overlean, thus increasing $NO_x$ emissions, and inviting knocking, misfiring and the like.

In the prior art, such a high temperature state of the $O_2$ sensor 13 can be detected by determining whether or not the minimum value of the output $V_{OX}$ of the $O_2$ sensor 13 is higher than a predetermined value such as $V_2$ in FIG. 4. Namely, when the minimum value of the output $V_{OX}$ is higher than the predetermined value $V_2$, various controls carried out, i.e., the heater 13*a* is turned OFF (see above-mentioned Japanese Unexamined Patent Publication No. 57-105529 and 57-143143).

Figure 5:
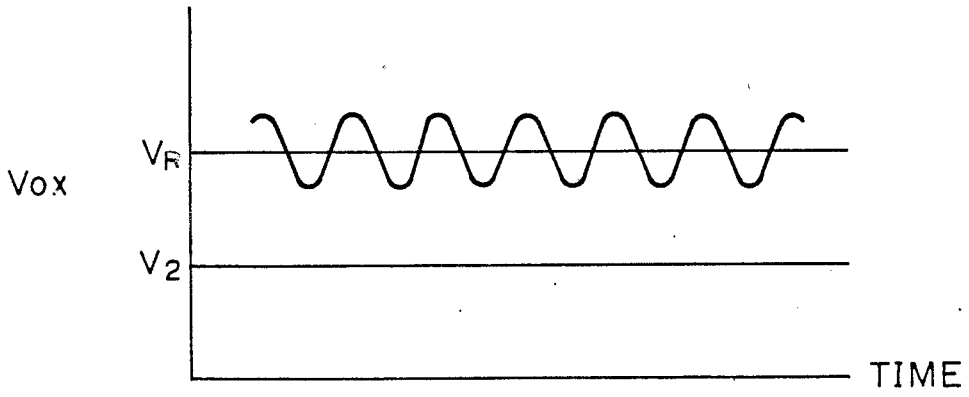
FIG. 5 is a timing diagram of an example of the output of the $O_2$ sensor of FIG. 1.

In the above-mentioned prior art, however, an erroneous determination may occur when the temperature of the $O_2$ sensor 13 is low. For example, when the $O_2$ sensor 13 is at a low temperature of about 450° to 500° C., the characteristic of the output $V_{OX}$ of the $O_2$ sensor 13 is slow, and as a result, when an air-fuel ratio feedback control is carried out in accordance with whether or not the output $V_{OX}$ of the $O_2$ sensor 13 is higher than the reference voltage $V_R$, the controlled air-fuel ratio is around $\lambda=\lambda_1$, and in addition, the amplitude of the output $V_{OX}$ of the $O_2$ sensor 13 is small due to the slow characteristic thereof, as illustrated in FIG. 5. Accordingly, the minimum value of the output $V_{OX}$ of the $O_2$ sensor 13 is higher than the predetermined value $V_2$, and thus a high temperature state is erroneously determined even when the temperature of the $O_2$ sensor 13 is actually low (450° to 500° C.).

In the present invention, such an erroneous determination can be avoided.

The operation of the control circuit 10 according to the present invention will be explained.

Figure 6:
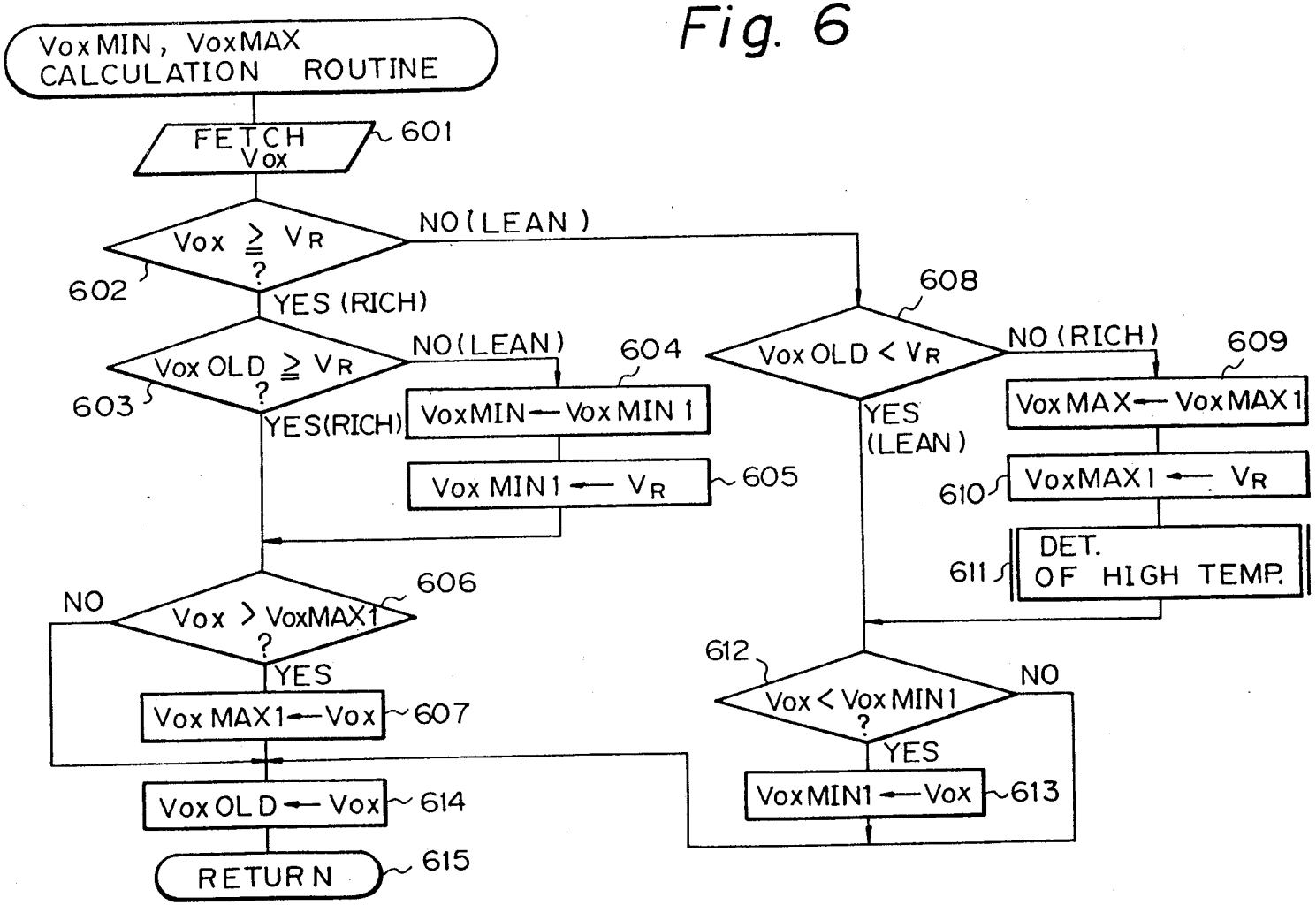
FIGS. 6, 7A, 7B, 9, 10, 12A, 12B, 12C, 13, 13A, 14, 18, 18A, 18B, 18C, 20, and 21 are flow charts showing the operation of the control circuit of FIG. 1.

FIG. 6 is a routine for calculating a minimum value $V_{OXmin}$ and a maximum value $V_{OXmax}$ of the output $V_{OX}$ of the $O_2$ sensor 13 executed at a predetermined time such as 4 ms.

At step 601, an A/D conversion is performed upon the output $V_{OX}$ of the $O_2$ sensor 13, and the A/D converted value thereof is fetched from the A/D converter 101. At step 602, the output $V_{OX}$ is compared with a reference voltage $V_R$ such as 0.45 V, to thereby determine whether the current air-fuel ratio is on the rich side or on the lean side with respect to the stoichiometric air-fuel ratio.

At step 602, if the air-fuel ratio is rich, the control proceeds to step 603 which determines whether the previous air-fuel ratio is rich or lean. Note that $V_{OXOLD}$ is a value of the previously fetched output $V_{OX}$. When the air-fuel ratio holds a rich state, the control proceeds to step 606 at which the output $V_{OX}$ is compared with a provisional maximum value $V_{OXmax1}$. As a result, only when $V_{OX}>V_{OXmax1}$, does the control proceed to step 607 at which the provisional maximum value $V_{OXmax1}$ is replaced by $V_{OX}$, i.e., $V_{OXmax1}\leftarrow V_{OX}$.

Then, at step 614, the previous output is $V_{OXOLD}$ is replaced by $V_{OX}$, to prepare for the next operation, and thus the routine of FIG. 6 is completed at step 615.

When the air-fuel ratio is switched from the rich side to the lean side, the control at step 602 is switched to step 608, and the control then proceeds via step 608 to step 609, at which the provisional maximum value $V_{OXmax1}$ is set to a maximum value $V_{OXmax}$. Also, at step 610, the provisional maximum value $V_{OXmax1}$ is initialized by $V_R$. Then, at step 611, a determination of a high temperature state of the $O_2$ sensor 13 is carried out. That is, this determination is carried out at every one period of the output $V_{OX}$ of the $O_2$ sensor 13. Note, step 611 will be later explained in detail.

When the air-fuel ratio holds a lean state, the control at step 608 proceeds to step 612 at which the output $V_{OX}$ is compared with a provisional minimum value $V_{OXmin1}$. As a result, only when $V_{OX}<V_{OXmin1}$, does the control proceed to step 613 at which the provisional minimum value $V_{OXmin1}$ is replaced by $V_{OX}$, i.e., $V_{OXmin1}\leftarrow V_{OX}$.

When the air-fuel ratio is switched from the lean side to the rich side, the control at step 602 is switched to step 603, and the control then proceeds via step 603 to step 604 at which the provisional minimum value $V_{OXmin1}$ is set to a minimum value $V_{OXmin}$. Also, at step 605, the provisional minimum value $V_{OXmin1}$ is initialized by $V_R$.

Thus, by the routine of FIG. 6, one minimum value $V_{OXmin}$ and one maximum value $V_{OXmax}$ are obtained for each period of the output $V_{OX}$ of the $O_2$ sensor 13.

Figure 7A:
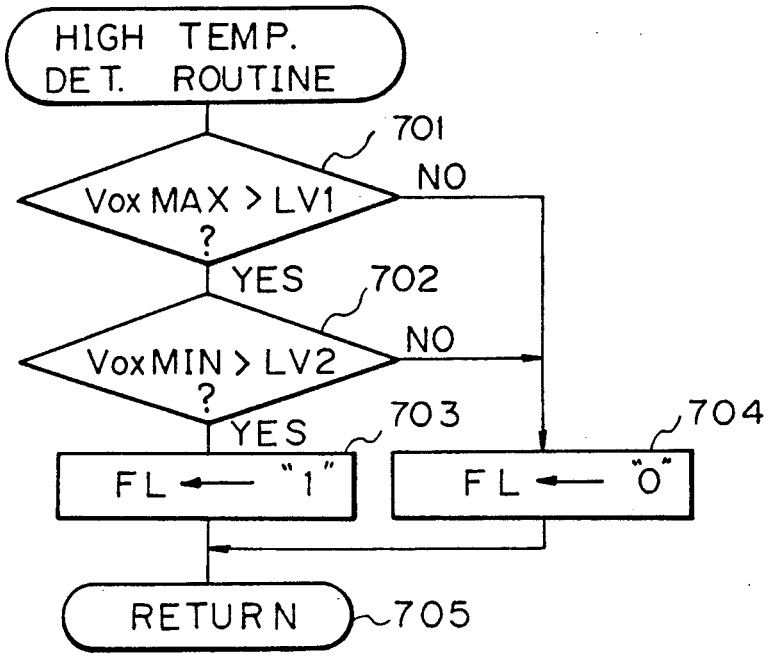

FIG. 7A is a detailed flow chart of the high temperature determining step 611 of FIG. 6. At step 701, the maximum value $V_{OXmax}$ is compared with a predetermined value LV1 such as 0.75 V to 0.80 V. Also, at step 702, the minimum value $V_{OXmin}$ is compared with a predetermined value LV2 such as 0.08 V to 0.25 V. As a result, only when $V_{OXmax}>LV1$ and $V_{OXmin}>LV2$, does the control proceed to step 703, at which an abnormal state flag FL is set. Alternatively, the control proceeds to step 704, at which the flag FL is reset, and the routine of FIG. 7A is completed at step 705.

Figure 8A:
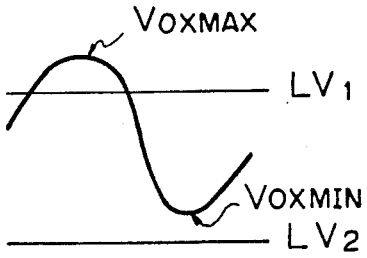
FIGS. 8A through 8D are timing diagrams explaining the flow charts of FIGS. 6 and 7.
Figure 8B:
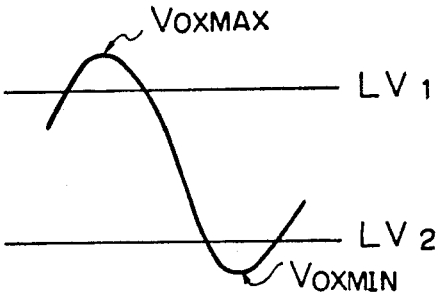
Figure 8C:
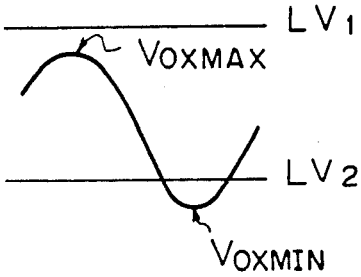
Figure 8D:
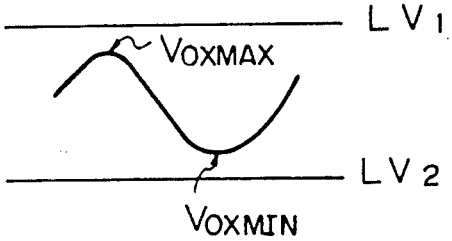

As illustrated in FIGS. 8A, 8B, 8C, and 8D, four states of the output $V_{OX}$ of the $O_2$ sensor 13 exist, and according to the routine of FIG. 7A, when the output $V_{OX}$ is changed as shown in FIG. 8A, the abnormal state flag FL is made "1", and when the output $V_{OX}$ of the output $V_{OX}$ is changed as shown in FIG. 8B, 8C, or 8D, the abnormal state flag FL is made "0", as follows:

TABLE I

| | FL |
|---|---|
| FIG. 8A | "1" |
| FIG. 8B | "0" |
| FIG. 8C | "0" |
| FIG. 8D | "0" |

Figure 7B:
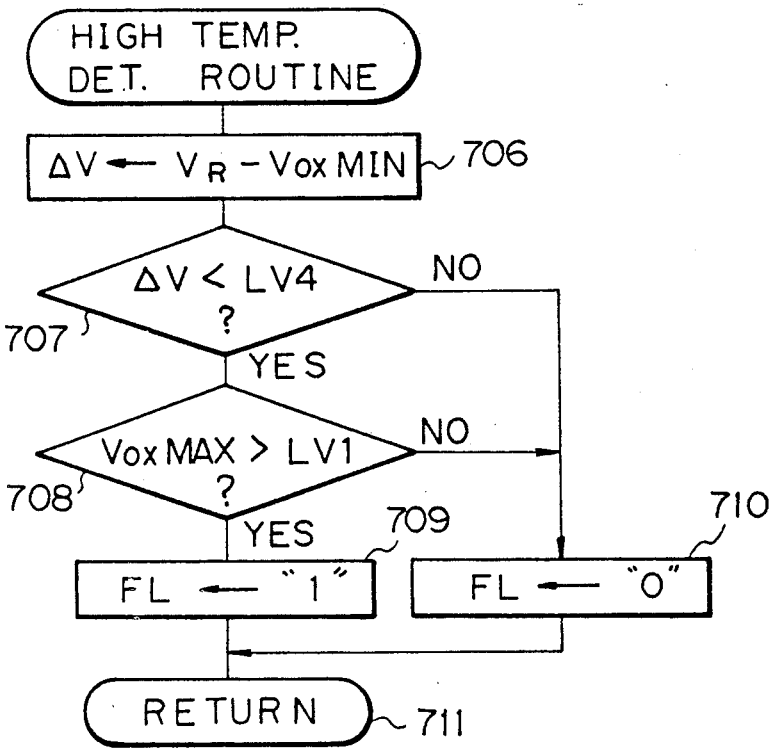

In FIG. 7B, which is a similar flow chent of FIG. 7A, steps 708 corresponds to step 701 of FIG. 7A, steps 706 and 707 correspond to step 702 of FIG. 7A, and steps 709, 710, and 110 correspond to steps 703, 704, and 705, respectively. That is, $V_R-LV4=LV2$. In this case, the value $\Delta V$ can be variable.

Figure 9:
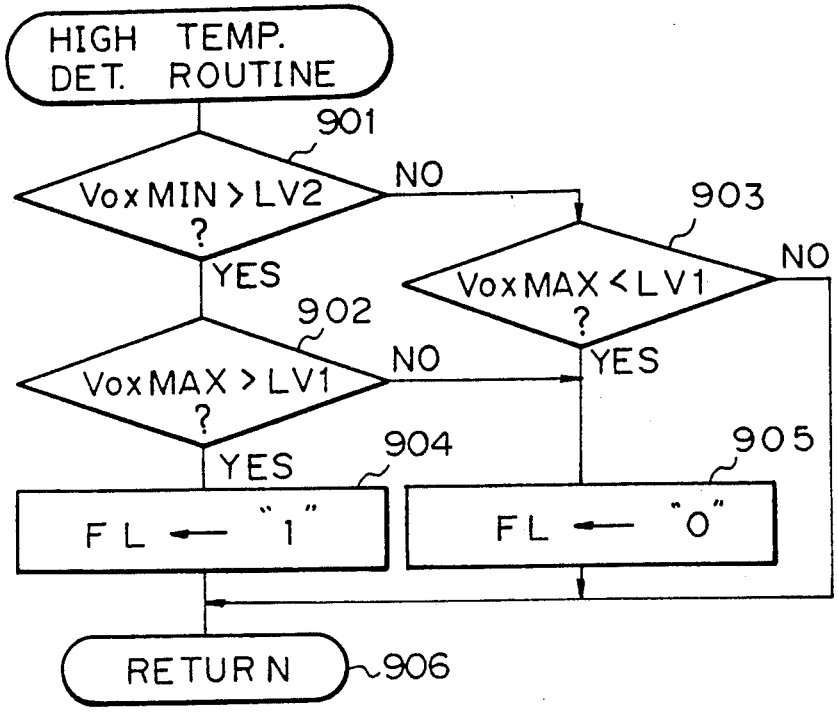

In FIG. 9, which is a modification of FIG. 7A, steps 901, 902, and 903 correspond to steps 701 and 702 of FIG. 7A, and steps 904, 905, and 906 correspond to steps 703, 704, and 705, respectively. Namely, at step 901, the minimum value $V_{OXmin}$ is compared with the predetermined value LV2, and at step 902, the maximum value $V_{OXmax}$ is compared with the predetermined value LV1. Further, at step 903, the maximum value $V_{OXmax}$ is compared with the predetermined value LV1. As a result, when $V_{OXmin}>LV2$ and $V_{OXmax}>LV1$, the control proceeds to step 904 at which the flag FL is set, and when $V_{OXmin}>LV2$ and $V_{OXmax}<LV1$, the control proceeds to step 905 at which the flag FL is reset. Alternatively, the control proceeds directly to step 906.

Thus, when the output $V_{OX}$ of the $O_2$ sensor 13 is changed as illustrated in FIGS. 8A, 8B, 8C, and 8D, the abnormal state flag FL is obtained by the routine of FIG. 9 as follows:

TABLE II

| | FL |
|---|---|
| FIG. 8A | "1" |
| FIG. 8B | UNCHANGED |
| FIG. 8C | "0" |
| FIG. 8D | "0" |

Figure 10:
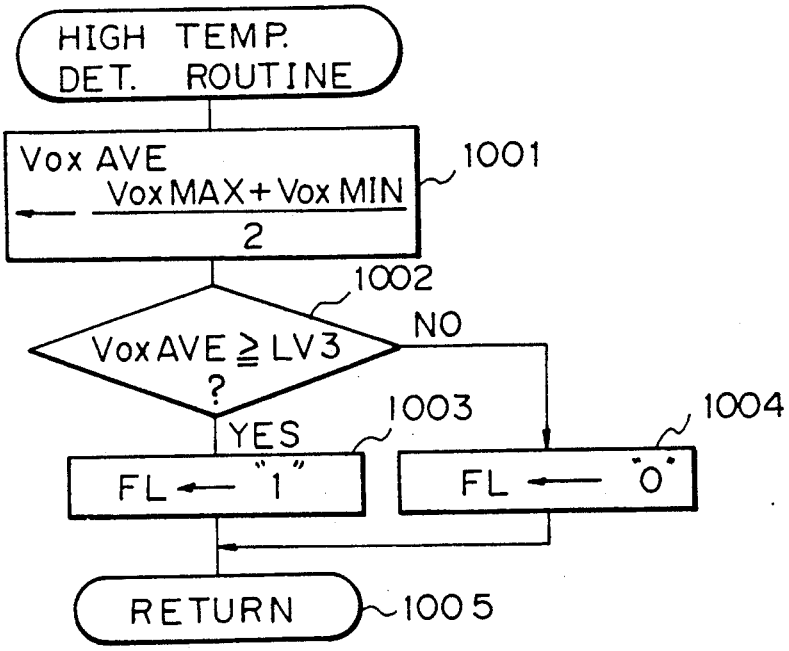

In FIG. 10, which is also a modification of FIG. 7A, steps 1001 and 1002 are provided instead of steps 701 and 702 of FIG. 7A, and steps 1003, 1004, and 1005 correspond to steps 703, 704, and 705, respectively, of FIG. 7A. Namely, at step 1001, an average value $V_{OXAVE}$ is calculated by $$V_{OXAVE}\leftarrow\frac{V_{OXmax}+V_{OXmin}}{2}$$

Then, at step 1002, the average value $V_{OXAVE}$ is compared with a predetermined value VL3 such as 0.6 V, and as a result, when $V_{OXAVE}\geqq VL3$, the control proceeds to step 1003 at which the abnormal state flag FL is set, and when $V_{OXAVE}<VL3$, the control proceeds to step 1004 at which the flag FL is reset, and the routine of FIG. 10 is completed at step 1005.

Thus, when the output $V_{OX}$ of the $O_2$ sensor 13 is changed as illustrated in FIGS. 8A, 8B, 8C, and 8D, the abnormal state flag FL is obtained by the routine of FIG. 10 as follows:

TABLE III

| | FL |
|---|---|
| FIG. 8A | "1" |
| FIG. 8B | "0" |
| FIG. 8C | "0" |
| FIG. 8D | "0" |

Namely, the operation of the routine of FIG. 10 is substantially the same as that of FIG. 7A.

As explained above, at least when the minimum value $V_{OXmin}$ and the maximum value $V_{OXmax}$ are both large, i.e., at least when the two values are both on the rich side, the abnormal state flag FL is set. Note that, as in the prior art, if the abnormal state flag FL is determined by using only the minimum value $V_{OXmin}$, the abnormal state flag FL is obtained by

TABLE IV

| | FL |
|---|---|
| FIG. 8A | "1" |
| FIG. 8B | "0" |
| FIG. 8C | "0" |
| FIG. 8D | "1" |

This means that the state of FIG. 8D is erroneously determined as a high temperature state. This erroneous determination can be avoided by the above-mentioned embodiments.

Figure 11:
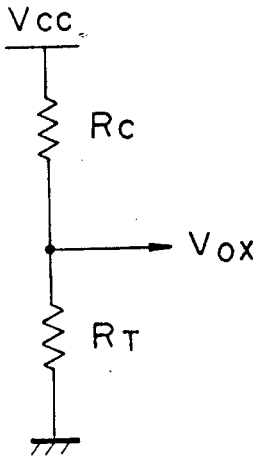
FIG. 11 is a circuit diagram of a modification of FIG. 3.
Figure 12A:
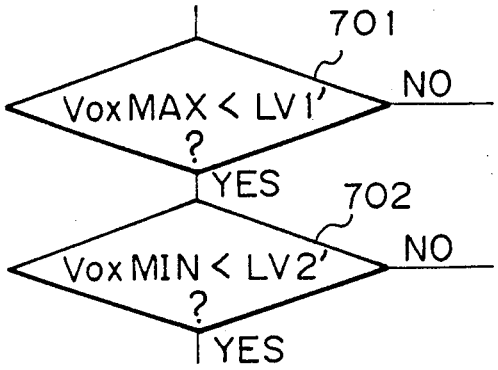
Figure 12B:
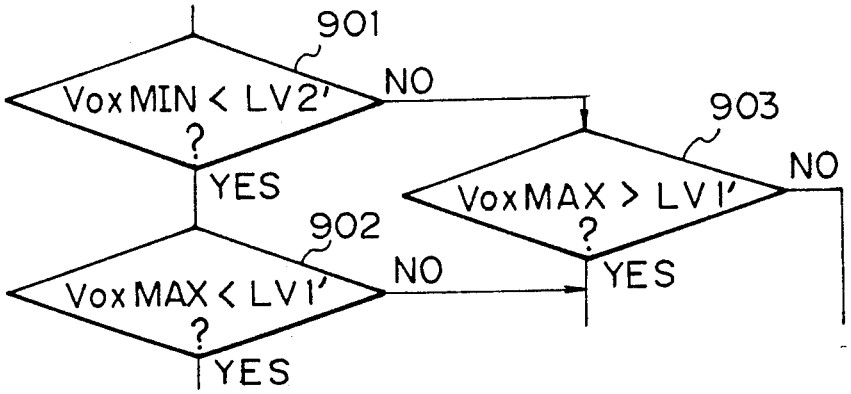
Figure 12C:
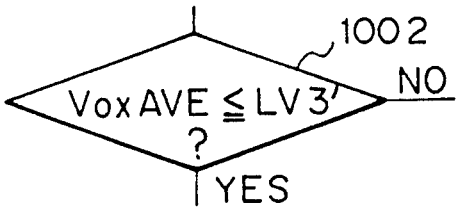

Also, the connection of the $O_2$ sensor 13 ($R_T$) and the reference resistor 1111 ($R_C$) can be modified as illustrated in FIG. 11. In this case, when the air-fuel ratio is rich, the output $V_{OX}$ is small, and when the air-fuel ratio is lean, the output $V_{OX}$ is large. Therefore, steps 701 and 702 of FIG. 7A, steps 901, 902, and 903 of FIG. 9, and step 1002 of FIG. 10 are modified as illustrated in FIGS. 12A, 12B, and 12C. In FIGS. 12A, 12B, and 12C, LV1', LV2' and LV3' are constants.

Next, the control of the heater 13*a* using the abnormal state flag FL will be explained with reference to FIGS. 13, 14, 15A, 15B, 16, 17A, 17B, and 17C.

Figure 13:
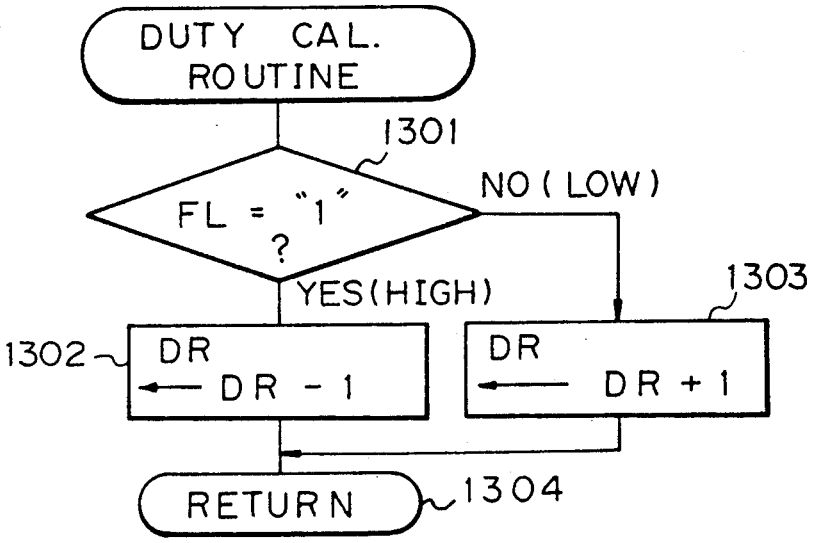

FIG. 13 is a routine for calculating a duty ratio DR in accordance with the abnormal state flag FL executed at a predetermined time such as 16 ms. At step 1301, it is determined whether or not the abnormal state flag FL is "1", i.e., the $O_2$ sensor 13 is in a high temperature state. As a result, when the $O_2$ sensor 13 is in a high temperature state, the control proceeds to step 1302 at which the duty ratio DR is reduced by 1, thus reducing the temperature of the $O_2$ sensor 13. Conversely, when the $O_2$ sensor 13 is not in a high temperature state the control proceeds to step 1303 at which the duty ratio DR is increased by 1, thus increasing the temperature of the $O_2$ sensor 13, and this routine is completed at step 1304.

Figure 13A:
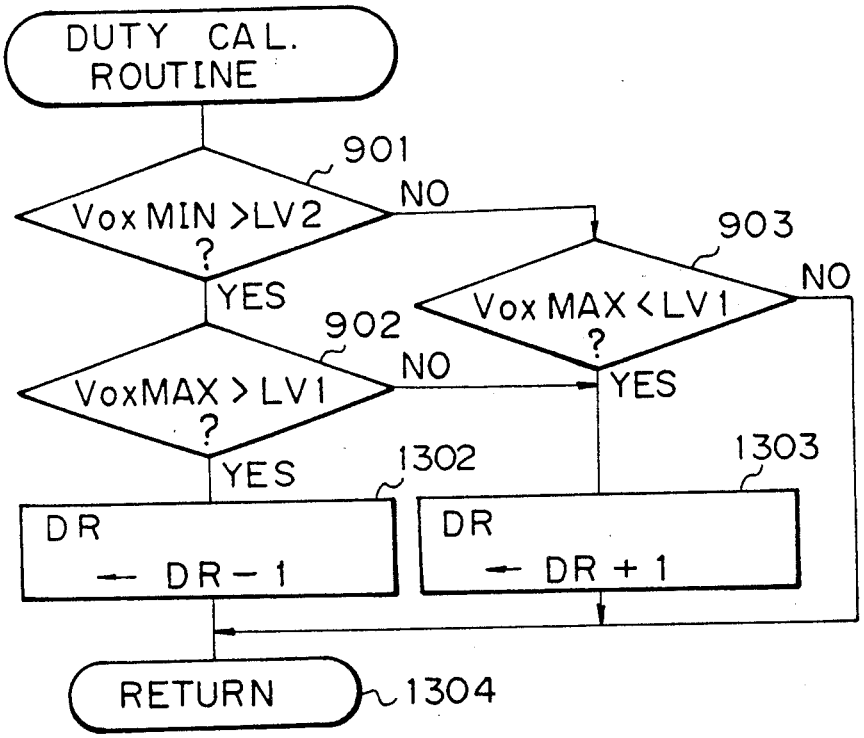

In FIG. 13, the duty ratio DR is changed directly by the abnormal state flag FL, and accordingly, the duty ratio DR is often changed and thus the duty ratio DR may be brought to a hunting state, which may invite the overheating of the element temperature of the $O_2$ sensor 13. To avoid this state, FIG. 13 can be modified as shown in FIG. 13A, in which the routine of FIG. 13 is combined with the routine of FIG. 9. Namely, when the $O_2$ sensor 13 is in a preferable temperature state, i.e., when the output $V_{OX}$ thereof is changed as illustrated in FIG. 8B, the duty ratio DR is unchanged, since the control at step 901 and 902 proceeds directly to step 1304.

Figure 14:
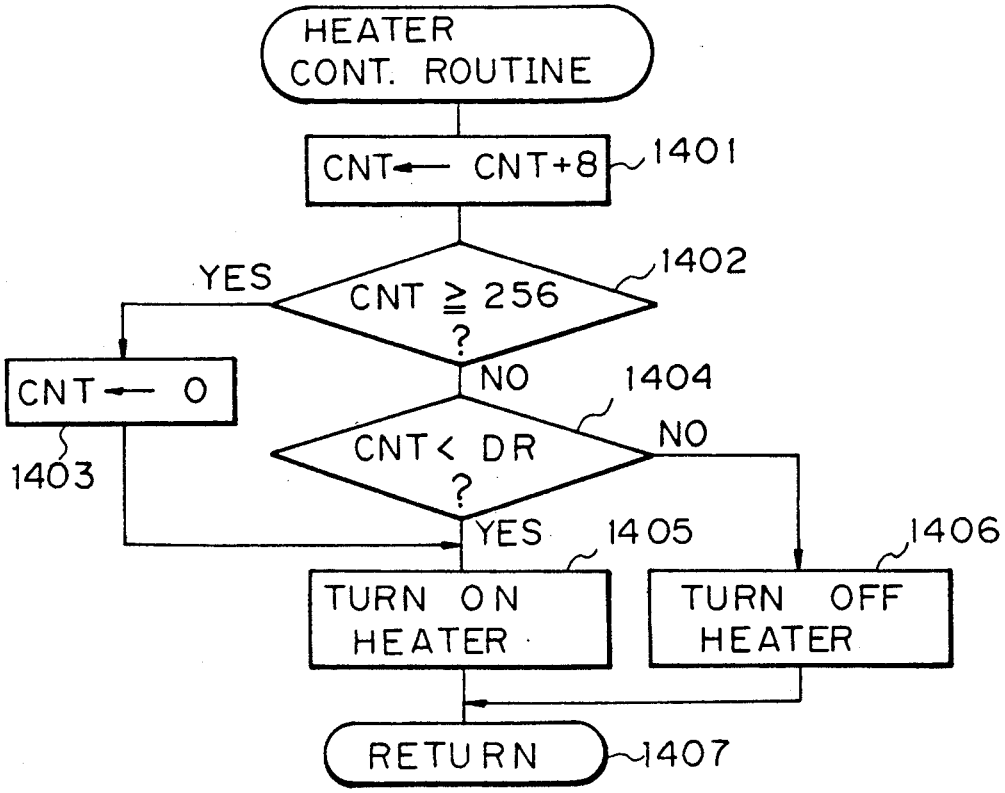
Figure 15A:
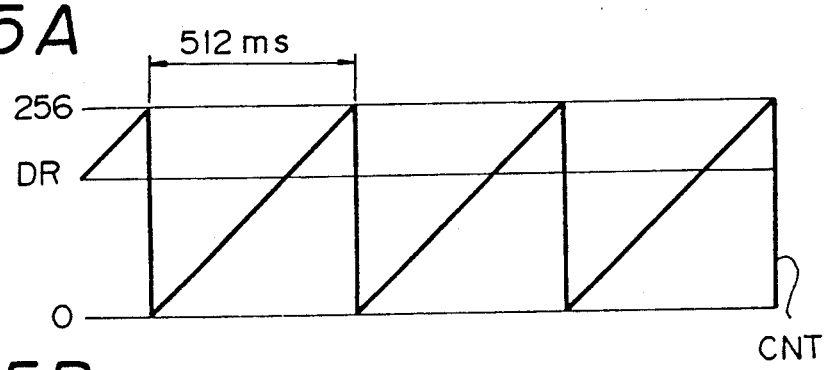
FIGS. 15A and 15B are timing diagrams explaining the flow chart of FIG. 14.

FIG. 14 is a routine for controlling the ON-duty ratio of the heater 13*a* in accordance with the duty ratio DR calculated by the routine of FIG. 13 or 13A, and executed at a predetermined time such as 16 ms. At step 1401, the value of a counter CNT is counted by 8, and at step 1402, it is determined whether or not the value of the counter CNT has reached a predetermined value such as 256 (=512 ms/16×8). As a result, when CNT≧256, the control proceeds to step 1403 at which the counter CNT is cleared. Then, at step 1405, the heater 13*a* is turned ON. Namely, as illustrated in FIG. 15A, the counter CNT is repeated for a predetermined time such as 512 ms. Conversely, when CNT<256, the control proceeds to step 1404, at which it is determined whether or not the value counter CNT has reached the duty ratio DR. As a result, when CNT>DR, the control proceeds to step 1405 at which the heater 13*a* is turned ON, and when CNT≧DR, the control proceeds to step 1406 and the heater 13*a* is turned OFF. Then, the routine of FIG. 14 is completed.

Figure 15B:
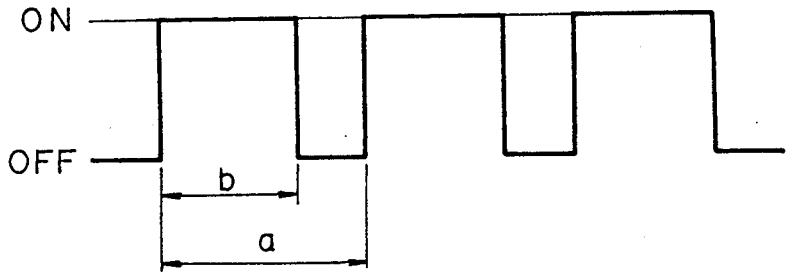
Figure 16:
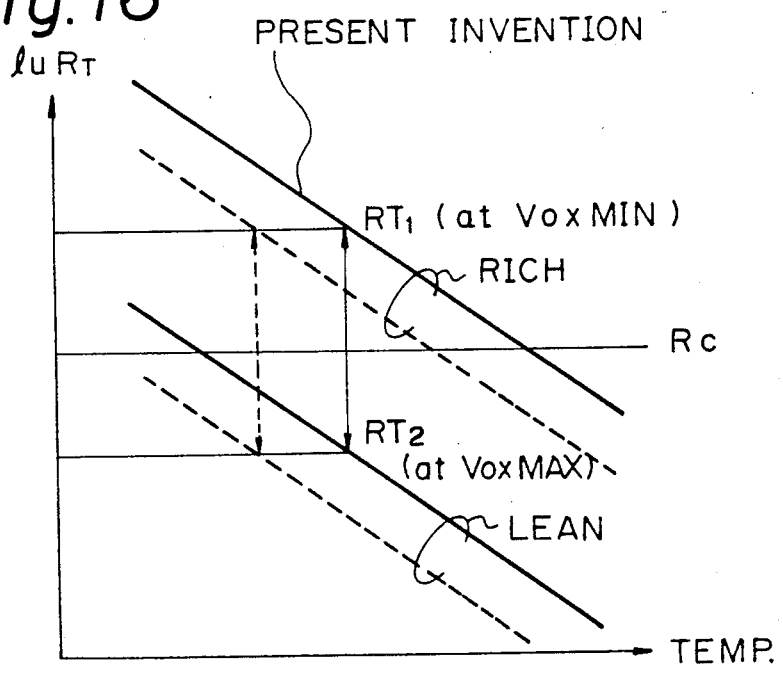
FIG. 16 is a graph showing the element temperature of the $O_2$ sensor of FIG. 1.

Thus, the heater 13*a* is turned ON for a period "b" (CNT=DR) per every period "a" (=512 ms) as illustrated by FIG. 15B, and therefore, the temperature of the heater 13 can be adjusted by the duty ratio DR (=b/a). Namely, the minimum value $V_{OXmin}$ and the maximum value $V_{OXmax}$ of the $O_2$ sensor 13 can be kept within a suitable range by adjusting the duty ratio DR of the heater 13 in accordance with whether or not the $O_2$ sensor 13 is in a high temperature state. This means that the $O_2$ sensor 13 can generate an accurate or ideal output $V_{OX}$ as indicated by the temperature 650° C. in FIG. 4, and thus a suitable air-fuel ratio feedback control can be carried out by using the output $V_{OX}$ of the $O_2$ sensor 13. This also enables a response time from the lean side to the rich side to be made the same as a response time from the rich side to the lean side. Namely, as illustrated in FIG. 16, the resistance value $R_T$ of the $O_2$ sensor 13, which in this case is a titania-type, is dependent upon the air-fuel ratio as well as the element temperature. Therefore, the heater 13*a* is controlled so as to satisfy the following condition:

$$\frac{\ln RT1 - \ln R_C}{\ln R_C - \ln RT2} = 1$$

where RT1 is the resistance value of the $O_2$ sensor 13 for the minimum value $V_{OXmin}$ thereof; and RT2 is the resistance value of the $O_2$ sensor 13 for the maximum value $V_{OXmax}$. Thus, the above-mentioned response times can be made the same.

Figure 17A:
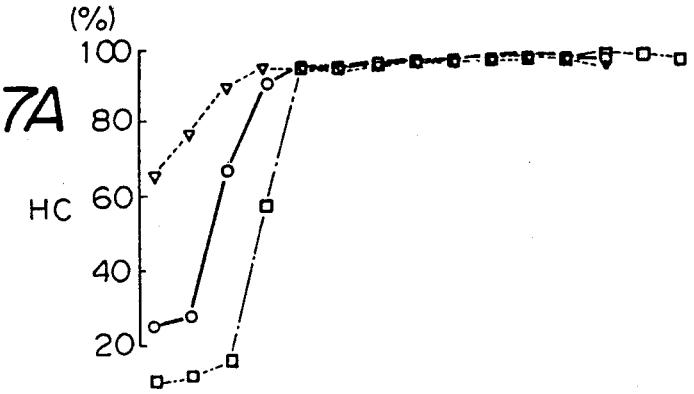
FIGS. 17A, 17B, and 17C are graphs of the exhaust emission characteristics of the catalyst converter of FIG. 1.
Figure 17B:
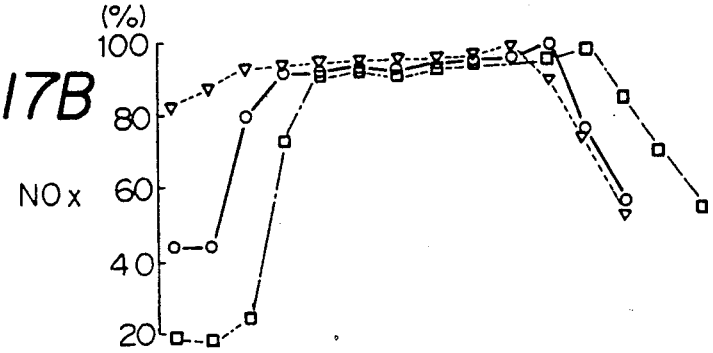
Figure 17C:
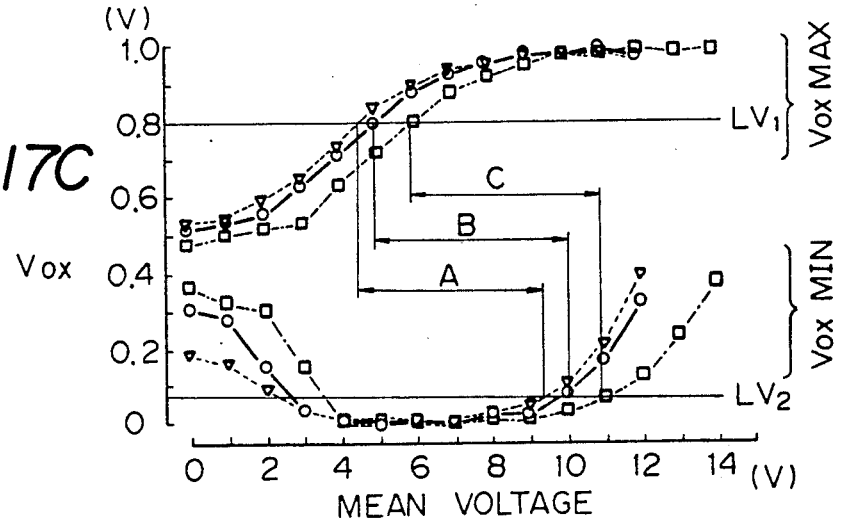

FIGS. 17A, 17B, and 17C are graphs for explaining the effect of the present invention. Namely, when the maximum value $V_{OXmax}$ is higher than the value LV1, and the minimum value is lower than the value LV2, as indicated by A, B, and C in FIG. 17C, the above-mentioned two response times are made substantially the same. As a result, the air-fuel ratio is brought by the feedback control of the output $V_{OX}$ of the $O_2$ sensor 13 to the stoichiometric air-fuel ratio, thus remarkably reducing the HC and CO emissions as illustrated in FIGS. 17A and 17B.

Also, the individual differences in the characteristics of the parts of the engine such as the $O_2$ sensor, the heater, and the like can be corrected by controlling the temperature of the $O_2$ sensor 13. Namely, each $O_2$ sensor 13 has individual characteristics caused during the manufacture thereof, due to aging thereof, and the like, but such individual characteristics can be countered by changing the resistance value $R_T$ of the $O_2$ sensor 13 in accordance with the temperature thereof. Also, when the heater 13a has a low ability, this ability can be enhanced by increasing the duty ratio DR of the applied voltage, thus countering the individual characteristics of the heater 13a. Similarly, the individual characteristics of the battery voltage, or drive conditions can be corrected by adjusting the duty ratio DR of the applied voltage of the heater 13a.

Note that the applied voltage of the heater 13a can be adjusted instead of the duty ratio DR thereof, in accordance with the abnormal state of the $O_2$ sensor 13, i.e., whether or not the $O_2$ sensor 13 is in a high temperature state.

As explained above, when the $O_2$ sensor 13 is in a high temperature state, a feedback control using the output $V_{OX}$ of the $O_2$ sensor 13 invites an overlean state. Therefore, instead of controlling of the heater 13a, the air-fuel ratio is corrected in accordance with whether or not the $O_2$ sensor 13 is in a high temperature state, which will be explained with reference to FIGS. 18, 19, 20, 21, and 22.

Figures 18, 18A:
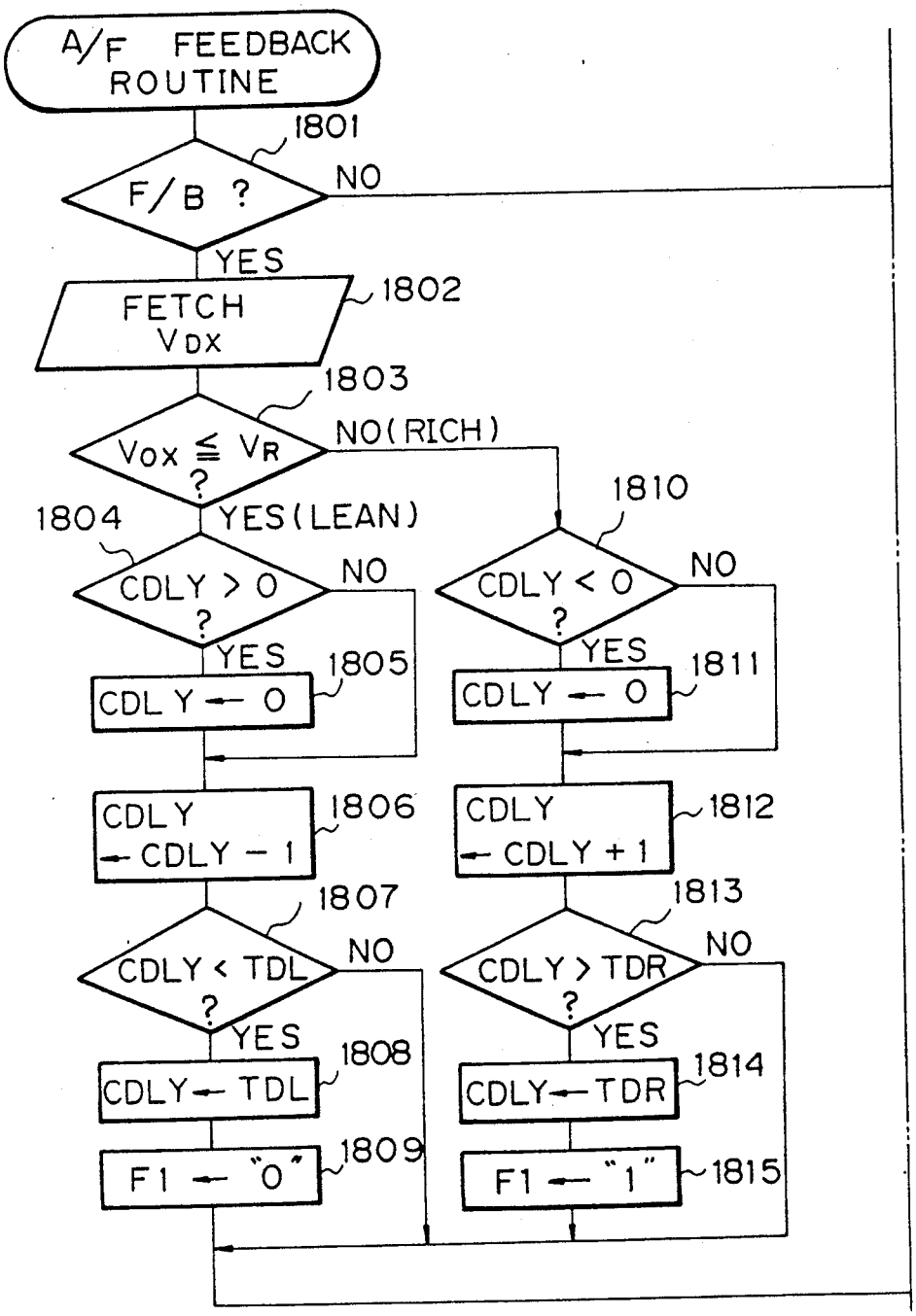
Figure 18B:
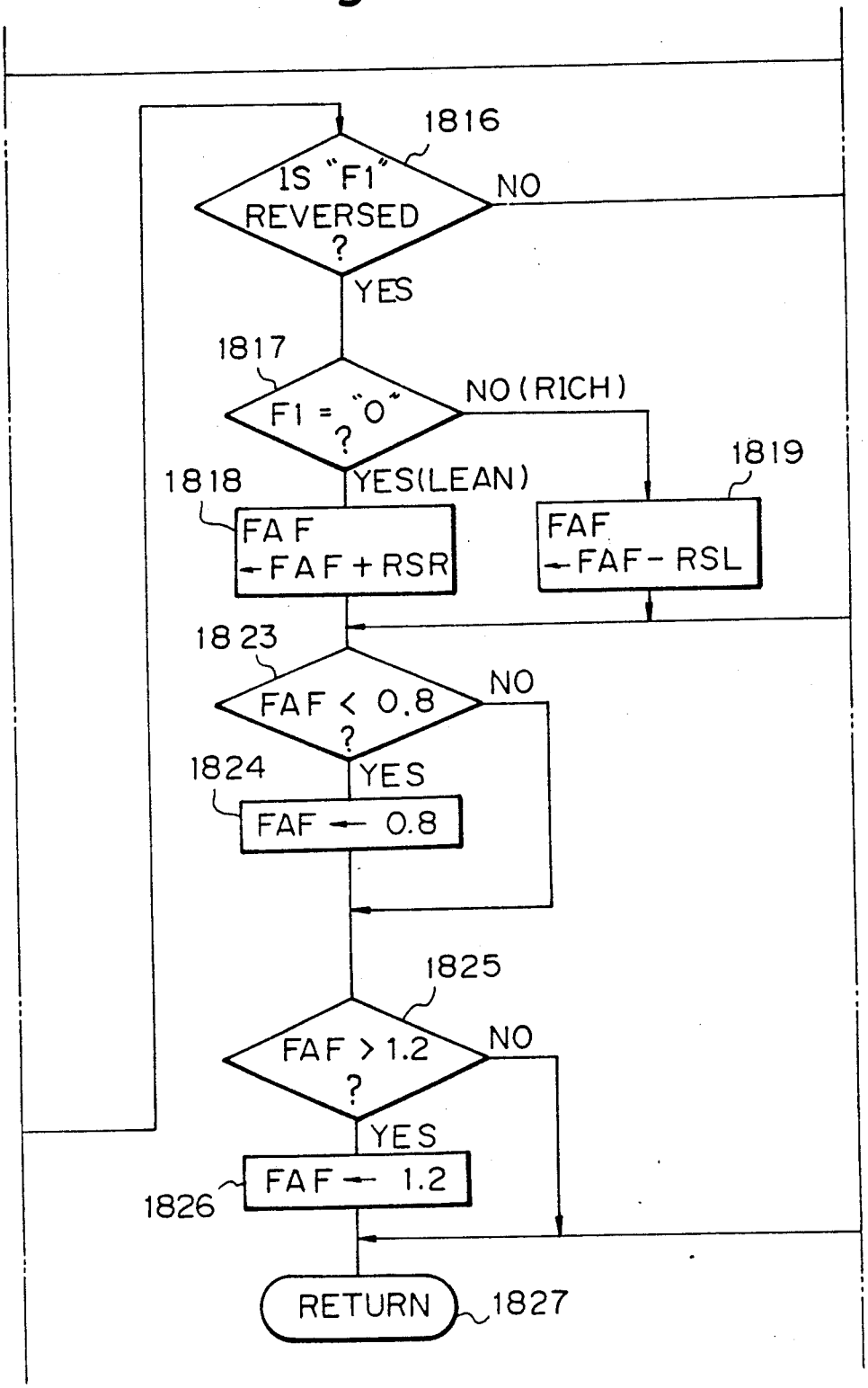
Figure 18C:
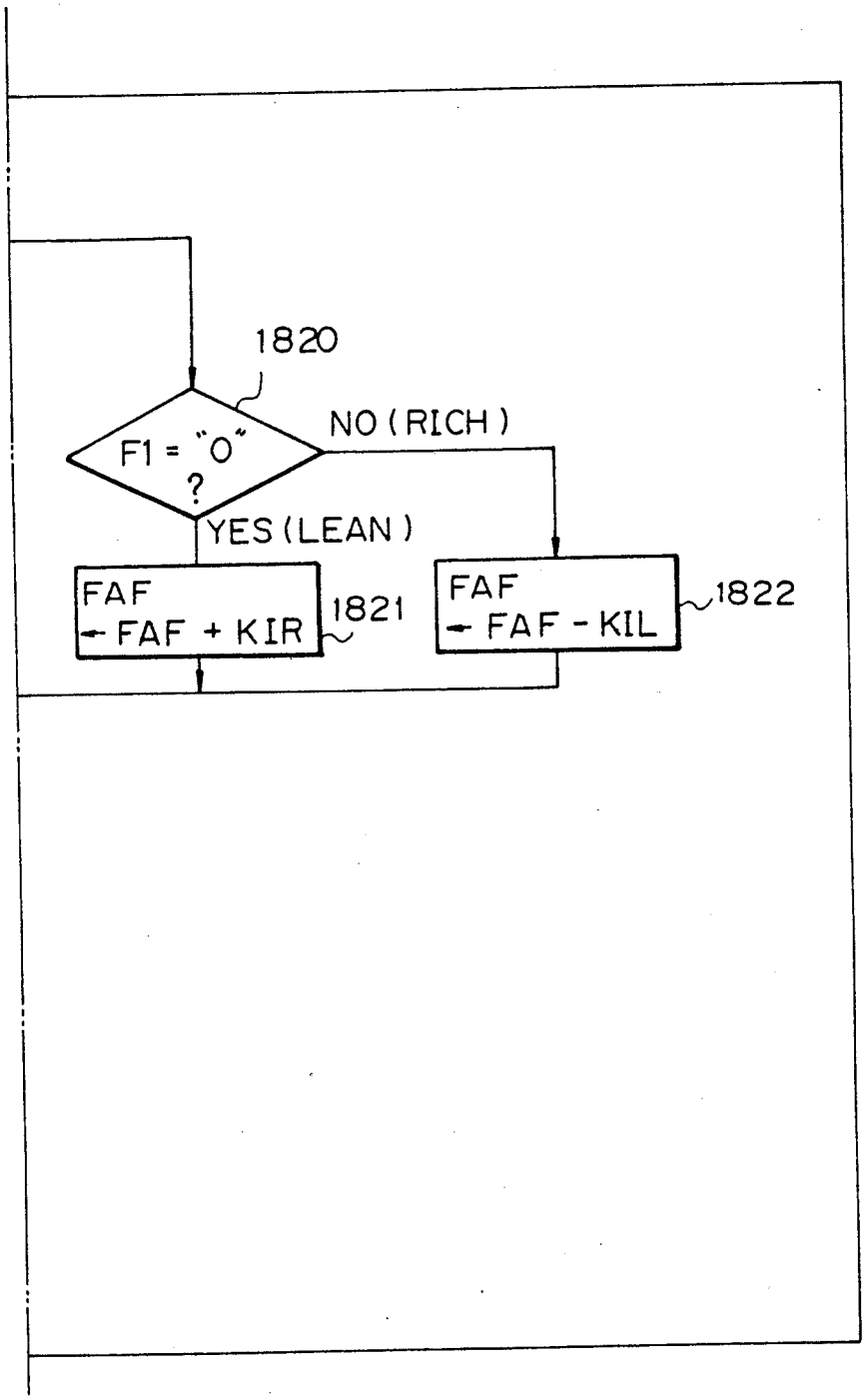

FIG. 18 is a routine for calculating an air-fuel ratio feedback correction amount FAF in accordance with the output $V_{OX}$ of the $O_2$ sensor 13 executed at a predetermined time such as 4 ms.

At step 1801, it is determined whether or not all of the feedback control (closed-loop control) conditions by the $O_2$ sensor 13 are satisfied. The feedback control conditions are as follows.

i) the engine is not in a fuel cut-off state;
ii) the engine is not in a starting state;
iii) the coolant temperature THW is higher than 50° C.
iv) the power fuel incremental amount FPOWER is 0; and
v) the $O_2$ sensor 13 is in an activated state Note that the determination of activation/nonactivation of the $O_2$ sensor 13 is carried out by determining whether or not the coolant temperature THW≧70° C., or by whether or not the output voltage $V_1$ of the $O_2$ sensor 13 is lower than a predetermined value. Of course, other feedback control conditions are introduced as occasion demands, but an explanation of such other feedback control conditions is omitted.

If one of more of the feedback control conditions is not satisfied, the control proceeds to step 1827, thereby carrying out an open-loop control operation. Note that, in this case, the amount FAF can be a value such as 1.0 or a mean value immediately before the open-loop control operation. That is, the amount FAF or a mean value FAF thereof is stored in the backup RAM 106, and in an open-loop control operation, the value FAF or FAF is read out of the backup RAM 106.

Contrary to the above, at step 1801, if all of the feedback control conditions are satisfied, the control proceeds to step 1802.

At step 1802, an A/D conversion is performed upon the output voltage $V_1$ of the $O_2$ sensor 13, and the A/D converted value thereof is then fetched from the A/D converter 101. Then at step 1803, the voltage $V_{OX}$ is compared with the reference voltage $V_R$, thereby determining whether the current air-fuel ratio detected by the $O_2$ sensor 13 is on the rich side or on the lean side with respect to the stoichiometric air-fuel ratio.

If $V_{OX} \leqq V_R$, which means that the current air-fuel ratio is lean, the control proceeds to step 1804, which determines whether or not the value of a delay counter CDLY is positive. If CDLY>0, the control proceeds to step 1805, which clears the delay counter CDLY, and then proceeds to step 1806. If CDLY≦0, the control proceeds directly to step 1806. At step 1806, the delay counter CDLY is counted down by 1, and at step 1807, it is determined whether or not CDLY<TDL. Note that TDL is a lean delay time period for which a rich state is maintained even after the output of the $O_2$ sensor 13 is changed from the rich side to the lean side, and is defined by a negative value. Therefore, at step 1807, only when CDLY<TDL does the control proceed to step 1808, which causes CDLY to be TDL, and then to step 1808, which causes an air-fuel ratio flag F1 to be "0" (lean state). On the other hand, if $V_{OX} > V_R$, which means that the current air-fuel ratio is rich, the control proceeds to step 1810, which determines whether or not the value of the delay counter CDLY is negative. If CDLY>0, the control proceeds to step 1811, which clears the delay counter CDLY, and then proceeds to step 1812. If CDLY≧0, the control directly proceeds to 1812. At step 1812, the delay counter CDLY is counted up by 1, and at step 1813, it is determined whether or not CDLY>TDR. Note that TDR is a rich delay time period for which a lean state is maintained even after the output of the $O_2$ sensor 13 is changed from the lean side to the rich side, and is defined by a positive value. Therefore, at step 1813, only when CDLY>TDR does the control proceed to step 1814, which causes CDLY to be TDR, and then to step 1815, which causes the air-fuel ratio flag F1 to be "1" (rich state).

Next, at step 1816, it is determined whether or not the air-fuel ratio flag F1 is reversed, i.e., whether or not the delayed air-fuel ratio detected by the $O_2$ sensor 13 is reversed. If the air-fuel ratio flag F1 is reversed, the control proceeds to steps 1817 to 1819, which carry out a skip operation.

At step 1817, if the flag F1 is "0" (lean), the control proceeds to step 1818, which remarkably increases the correction amount FAF by a skip amount RSR. Also, if the flag F1 is "1" (rich) at step 1817, the control proceeds to step 1819, which remarkably decreases the correction amount FAF by a skip amount RSL.

On the other hand, if the air-fuel ratio flag F1 is not reversed at step 1816, the control proceeds to steps 1820 to 1822, which carries out an integration operation. That is, if the flag F1 is "0" (lean) at step 1820, the control proceeds to step 1821, which gradually increases the correction amount FAF by a rich integration amount KIR. Also, if the flag F1 is "1" (rich) at step 1820, the control proceeds to step 1822 which gradually decreases the correction amount FAF by a lean integration amount KIL.

The correction amount FAF is guarded by a minimum value 0.8 at steps 1823 and 1824. Also, the correction amount FAF is guarded by a maximum value 1.2 at steps 1825 and 1826. Thus, the controlled air-fuel ratio is prevented from becoming overlean or overrich.

The correction amount FAF is then stored in the RAM 105, thus completing this routine of FIG. 18 at steps 1828.

Figures 19A, 19B, 19C, 19D:
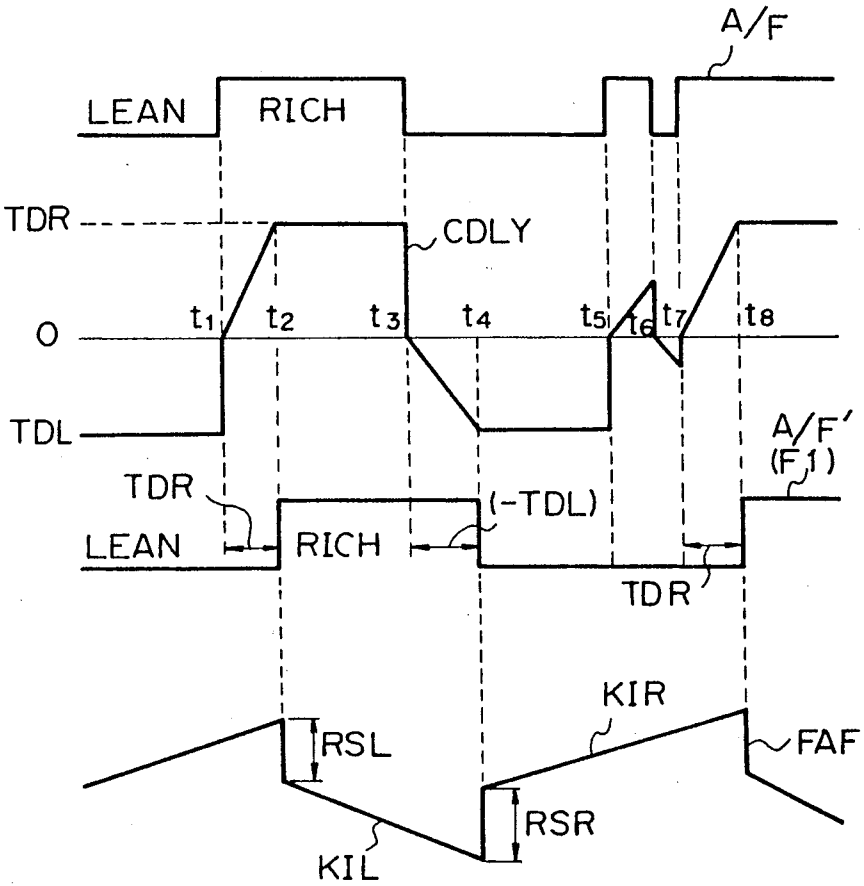
FIGS. 19A, 19B, 19C, and 19D are timing diagrams explaining the flow chart of FIG. 18.

The operation by the flow chart of FIG. 18 will be further explained with reference to FIGS. 19A through 19D. As illustrated in FIG. 18A, when the air-fuel ratio A/F is obtained by the output $V_{OX}$ of the $O_2$ sensor 13, the delay counter CDLY is counted up during a rich state, and is counted down during a lean state, as illustrated in FIG. 19B. As a result, a delayed air-fuel ratio corresponding to the air-fuel ratio flag F1 is obtained as illustrated in FIG. 19C. For example, at time $t_1$, even when the air-fuel ratio A/F is changed from the lean side to the rich side, the delayed air-fuel ratio A/F' (F1) is changed at time $t_2$ after the rich delay time period TDR. Similarly at time $T_3$, even when the air-fuel ratio A/F is changed from the rich side to the lean side, the delayed air-fuel ratio F1' is changed at time $t_4$ after the lean delay time period TDL. However, at time $t_5$, $t_6$, or $t_7$, when the air-fuel ratio A/F is reversed within a shorter time than the rich delay time TDR or the lean delay time TDL, the delay air-fuel ratio A/F' is reversed at time $t_8$. That is, the delayed air-fuel ratio A/F' is stable when compared with the air-fuel ratio A/F. Further, as illustrated in FIG. 19D, at every change of the delayed air-fuel ratio A/F' from the rich side to the lean side, or vice versa, the correction amount FAF is skipped by the skip amount RSR or RSL, and in addition, the correction amount FAF is gradually increased or decreased in accordance with the delayed air-fuel ratio A/F'.

Air-fuel ratio feedback control operations by the temperature of the $O_2$ sensor 13 will be explained. As the air-fuel ratio feedback control parameter, there are nominated a delay time TD (in more detail, the rich delay time TDR and the lean delay time TDL), a skip amount RS (in more detail, the rich skip amount RSR and the lean skip amount RSL), an integration amount KI (in more detail, the rich integration amount KIR and the lean integration amount KIL), and the reference voltage $V_R$.

For example, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the temperature of the $O_2$ sensor. Also, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the temperature of the $O_2$ sensor 13. Further, if the rich delay time TDR becomes longer or if the lean delay time TDL becomes shorter, the controlled air-fuel becomes richer, and if the lean delay time TDL becomes longer or if the rich delay time TDL becomes shorter, the controlled air-fuel ratio becomes leaner. Thus, the air-fuel ratio can be controlled by changing the rich delay time TDR and the lean delay time (—TDL) in accordance with the temperature of the $O_2$ sensor 13. Still further, if the reference voltage $V_R$ is increased, the controlled air-fuel ratio becomes richer, and if the reference voltage $V_R$ is decreased, the controlled air-fuel ratio becomes leaner. Thus, the air-fuel ratio can be controlled by changing the reference volta $V_R$ in accordance with the temperature of the $O_2$ sensor 13.

Figure 20:
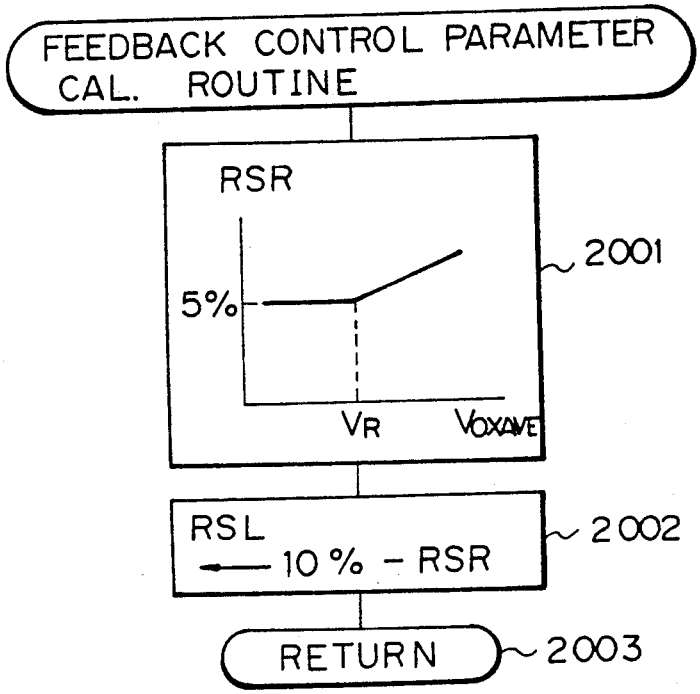

FIG. 20 is a routine for calculating the skip amounts RSR and RSL in accordance with the temperature of the $O_2$ sensor 13 executed at a predetermined time such as 1 s. At step 2001, the rich skip amount RSR is calculated from a one-dimensional map by using the temperature of the $O_2$ sensor 13, which in this case is the average output $V_{OXAVE}$ of the output $V_{OX}$ of the $O_2$ sensor 13 obtained by the routine of FIG. 10. Namely, when the temperature of the $O_2$ sensor 13 is higher, and accordingly, the average output $V_{OXAVE}$ thereof is higher, the rich skip amount RSR is increased to move the air-fuel ratio to the rich side. At step 2002, the lean skip amount RSL is calculated by $$RSL \leftarrow 10\% - RSR$$

and this routine is completed at step 2003.

Figure 21:
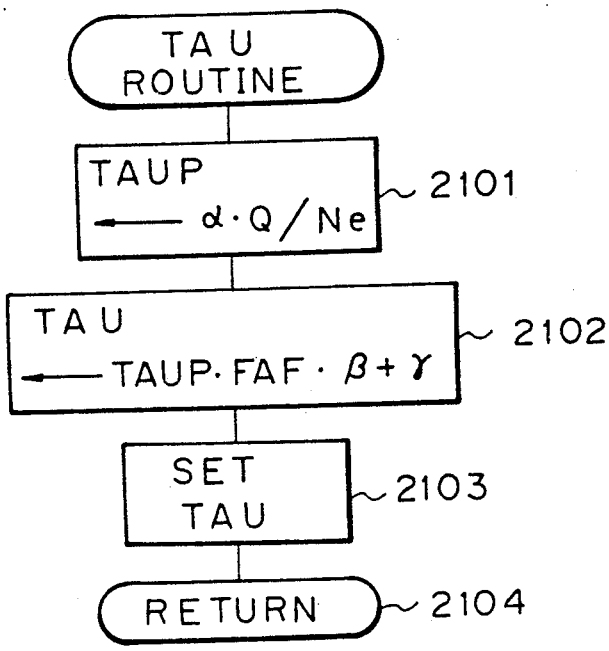

FIG. 21 is a routine for calculating a fuel injection amount TAU executed at every predetermined crank angle such as 360° CA. At step 2101, a base fuel injection amount $TAU_P$ is calculated by using the intake air amount data Q and the engine speed data Ne stored in the RAM 105. That is, $$TAUP \leftarrow \alpha . Q/Ne$$

where $\alpha$ is a constant. Then at step 2102, a final fuel injection amount TAU is calculated by $$TAUP \leftarrow TAUP.FAF.\beta + \gamma$$

where $\beta$ and $\gamma$ are correction factors determined by other parameters such as the voltage of the battery and the temperature of the intake air. At step 2103, the final fuel injection amount TAU is set in the down counter 107, and in addition, the flip-flop 108 is set to initiate the activation of the fuel injection valve 7. Then, this routine is completed by step 2104. Note that, as explained above, when a time period corresponding to the amount TAU has passed, the flip-flop 109 is reset by the borrow-out signal of the down counter 108 to stop the activation of the fuel injection.

Figure 22:
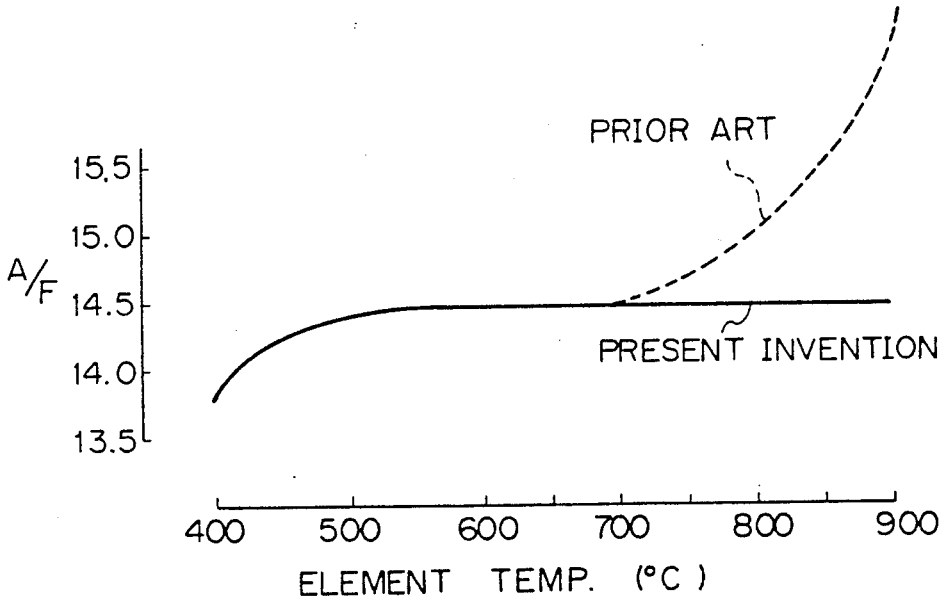
FIG. 22 is a graph showing the effect of the present invention.

According to the routines of FIGS. 18, 19, 20, and 21, the air-fuel ratio controlled by the feedback of the output $V_{OX}$ of the $O_2$ sensor 13 can be brought close to the stoichiometric air-fuel ratio even when the element temperature of the $O_2$ sensor 13 is high, as illustrated in FIG. 22.

Note that, in FIG. 20, other air-fuel ratio feedback control parameters such as the integration amounts KIR and KIL, the delay periods TDR and TDL, or the reference voltage $V_R$ instead of the skip amounts RSR and RSL can be changed in accordance with the temperature of the $O_2$ sensor 13.

Also, $O_2$ sensors other than the titania-type $O_2$ sensor can be used, if such $O_2$ sensors have similar temperature characteristics.

Still further, a Karman vortex sensor, a heat-wire type flow sensor, and the like can be used instead of the vene type airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine is which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 2101 of FIG. 21 is determined by the carburetor itself, i.e., the intake air negative pressure and the engine speed, and the air amount corresponding to TAU is calculated at step at step 2102 of FIG. 21.

As explained above, according to the present invention, a distinct high temperature state of the air-fuel ratio sensor ($O_2$ sensor) can be detected by using two extreme values of the output thereof.

We claim:

1. A method of determining an element temperature of an air-fuel ratio sensor for detecting a concentration of a specific component in the exhaust gas of an internal combustion engine, comprising the steps of:

determining whether the output of said air-fuel ratio sensor indicates a lean state or a rich state of said engine;

calculating a lean-side extreme value of the output of said air-fuel ratio sensor when a lean state of said engine is indicated;

calculating a rich-side extreme value of the output of said air-fuel ratio sensor when a rich state of said engine is indicated;

determining whether or not said lean-side extreme value is on the rich side with respect to a first predetermined value;

determining whether or not said rich-side extreme value is on the rich side with respect to a second predetermined value;

determining that said air-fuel ratio sensor is at a high temperature state when said lean-side extreme value is on the rich side with respect to said first predetermined value and said rich-side extreme value is on the rich side with respect to said second predetermined value;

lowering the element temperature of said air-fuel ratio sensor to a low temperature state other than said high temperature state when said air-fuel ratio sensor is determined to be at said high temperature state; and raising the element temperature of said air-fuel ratio sensor to said high temperature state when said air-fuel ratio sensor is at said low temperature state.

2. A method as set forth in claim 1, wherein said air-fuel ratio sensor comprises a titania type air-fuel ratio sensor.

3. A method of determining an element temperature of an air-fuel ratio sensor for detecting a concentration of a specific component in the exhaust gas of an internal combustion engine, comprising the steps of:

determining whether the output of said air-fuel ratio sensor indicates a lean state or a rich state of said engine;

calculating a lean-side extreme value of the output of said air-fuel ratio sensor when a lean state of said engine is indicated;

calculating a rich-side extreme value of the output of said air-fuel ratio sensor when a rich state of said engine is indicated;

calculating a mean value of said lean-side extreme value and said rich-side extreme value;

determining whether or not said mean value is on the rich side with respect to a predetermined value;

determining that said air-fuel ratio sensor is at a high temperature state when said mean value is on the rich side with respect to said predetermined value;

lowering the element temperature of said air-fuel ratio sensor to a low temperature state other than said high temperature state when said air-fuel ratio sensor is determined to be at said high temperature state; and raising the element temperature of said air-fuel ratio sensor to said high temperature state when said air-fuel ratio sensor is at said low temperature state.

4. A method as set forth in claim 3, further comprising the steps of:

calculating an air-fuel ratio feedback control parameter in accordance with said mean value;

calculating an air-fuel correction amount in accordance with said air-fuel ratio feedback control parameter and the output of said air-fuel ratio sensor; and adjusting an actual air-fuel ratio in accordance with said air fuel ratio correction amount.

5. A method as set forth in claim 4, wherein said air-fuel ratio feedback control parameter is defined by a lean skip amount by which said air-fuel ratio correction amount is skipped down when the output of said air-fuel ratio sensor is switched from the lean side to the rich side and a rich skip amount by which said air-fuel ratio correction amount is skipped up when the output of said air-fuel ratio sensor is switched from the rich side to the lean side.

6. A method as set forth in claim 4, wherein said air-fuel ratio feedback control parameter is defined by a lean integration amount by which said air-fuel ratio correction amount is gradually decreased when the output of said air-fuel ratio sensor is on the rich side and a rich integration amount by which said air-fuel ratio correction amount is gradually increased when the output of said air-fuel ratio sensor is on the lean side.

7. A method as set forth in claim 4, wherein said air-fuel ratio feedback control parameter is determined by a rich delay time for delaying the output of said air-fuel ratio sensor switched from the lean side to the rich side and a lean delay time for delaying the output of said air-fuel ratio sensor switched from the rich side to the lean side.

8. A method as set forth in claim 4, wherein said air-fuel ratio feedback control parameter is determined by a reference voltage with which the output of said air-fuel ratio sensor is compared, thereby determining whether the air-fuel ratio is on the rich side or on the lean side.

9. A method as set forth in claim 3, wherein said air-fuel ratio sensor comprises a titania type air-fuel ratio sensor.

10. An apparatus for determining an element temperature of an air-fuel ratio sensor for detecting a concentration of a specific component in the exhaust gas of an internal combustion engine, comprising:

means for determining whether the output of said air-fuel ratio sensor indicates a lean state or a rich state of said engine;

means for calculating a lean-side extreme value of the output of said air-fuel ratio sensor when a lean state of said engine is indicated;

means for calculating a rich-side extreme value of the output of said air-fuel ratio sensor when a rich state of said engine is indicated;

means for determining whether or not said lean-side extreme value is on the rich side with respect to a first predetermined value;

means for determining whether or not said rich-side extreme value is on the rich side with respect to a second predetermined value;

means for determining that said air-fuel ratio sensor is at a high temperature state when said lean-side extreme value is on the rich side with respect to said first predetermined value and said rich-side extreme value is on the rich side with respect to said second predetermined value;

means for lowering the element temperature of said air-fuel ratio sensor to a low temperature state other than said high temperature state when said air-fuel ratio sensor is determined to be at said high temperature state; and means for raising the element temperature of said air-fuel ratio sensor to said high temperature state when said air-fuel ratio sensor is at said low temperature state.

11. An apparatus as set forth in claim 10, wherein said air-fuel ratio sensor comprises a titania type air-fuel ratio sensor.

12. An apparatus for determining an element temperature of an air-fuel ratio sensor for detecting a concentration of a specific component in the exhaust gas of an internal combustion engine, comprising:

means for determining whether the output of said air-fuel ratio sensor indicates a lean state or a rich state of said engine;

means for calculating a lean-side extreme value of the output of said air-fuel ratio sensor when a lean state of said engine is indicated;

means for calculating a rich-side extreme value of the output of said air-fuel ratio sensor when a rich state of said engine is indicated;

means for calculating a mean value of said lean-side extreme value and said rich-side extreme value;

means for determining whether or not said mean value is on the rich-side with respect to a predetermined value;

means for determining that said air-fuel ratio sensor is at a high temperature state when said mean value is on the rich side with respect to said predetermined value;

means for lowering the element temperature of said air-fuel ratio sensor to a low temperature state other than said high temperature state when said air-fuel ratio sensor is determined to be at said high temperature state; and means for raising the element temperature of said air-fuel ratio sensor to said high temperature state when said air-fuel ratio sensor is at said low temperature state.

13. An apparatus as set forth in claim 12, further comprising:

means for calculating an air-fuel ratio feedback control parameter in accordance with said mean value;

means for calculating an air-fuel correction amount in accordance with said air-fuel ratio feedback control parameter and the output of said air-fuel ratio sensor; and means for adjusting an actual air-fuel ratio in accordance with said air-fuel ratio correction amount.

14. An apparatus as set forth in claim 13, wherein said air-fuel ratio feedback control parameter is defined by a lean skip amount by which said air-fuel ratio correction amount is skipped down when the output of said air-fuel ratio sensor is switched from the lean side to the rich side and a rich skip amount by which said air-fuel ratio correction amount is skipped up when the output of said air-fuel ratio sensor is switched from the rich side to the lean side.

15. An apparatus as set forth in claim 13, wherein said air-fuel ratio feedback control parameter is defined by a lean integration amount by which said air-fuel ratio correction amount is gradually decreased when the output of said air-fuel ratio sensor is on the rich side and a rich integration amount by which said air-fuel ratio correction amount is gradually increased when the output of said air-fuel ratio sensor is on the lean side.

16. An apparatus as set forth in claim 13, wherein said air-fuel ratio feedback control parameter is determined by a rich delay time for delaying the output of said air-fuel ratio sensor switched from the lean side to the rich side and a lean delay time for delaying the output of said air-fuel ratio sensor switched from the rich side to the lean side.

17. An apparatus as set forth in claim 13, wherein said air-fuel ratio feedback control parameter is determined by a reference voltage with which the output of said air-fuel ratio sensor is compared, thereby determining whether the air-fuel ratio is on the rich side or on the lean side.

18. An apparatus as set forth in claim 12, wherein said air-fuel ratio sensor comprises a titania type air-fuel ratio sensor.

* * * * *

UNITED STATES PATENT AND TRADEMARK OFFICE

CERTIFICATE OF CORRECTION

PATENT NO. : 5,036,470

DATED : July 30, 1991

INVENTOR(S) : Suzuki, M., et al.

It is certified that error appears in the above-identified patent and that said Letters Patent is hereby corrected as shown below:

Title Page:
Abstract, line 3, delete "ration" and insert --ratio--;

Column 5, line 25, delete the first occurrence of "is";

Column 6, line 15, delete "chent" and insert --chart--;

Column 6, line 16, delete "steps" (1st occurrence) and insert --step--;

Column 8, line 53, after "valve" insert --$V_{OXmin}$--;

Column 9, line 17, delete the second occurrence of "of";

Column 12, line 60, delete "is" and insert--in--; and

Column 13, line 3, delete the second occurrence of "at step".

Signed and Sealed this

Second Day of March, 1993

*Attest:*

STEPHEN G. KUNIN

*Attesting Officer*

*Acting Commissioner of Patents and Trademarks*